US005118046A

United States Patent [19]

Tholander

[11] Patent Number: 5,118,046

[45] Date of Patent: Jun. 2, 1992

[54] APPARATUS FOR DETECTING A YARN MOVEMENT

[75] Inventor: Lars H. G. Tholander, Huskvarna, Sweden

[73] Assignee: IRO AB, Ulricehamn, Sweden

[21] Appl. No.: 415,292

[22] PCT Filed: Mar. 11, 1988

[86] PCT No.: PCT/EP88/00192

§ 371 Date: Oct. 20, 1989

§ 102(e) Date: Oct. 20, 1989

[87] PCT Pub. No.: WO88/07018

PCT Pub. Date: Sep. 22, 1988

[30] Foreign Application Priority Data

Mar. 11, 1987 [DE] Fed. Rep. of Germany ..... 3707875

[51] Int. Cl.[5] ..... B65H 59/22; B65H 63/00

[52] U.S. Cl. ..... 242/152.1; 242/36; 242/37 R; 242/148

[58] Field of Search ..... 242/152.1, 147 R, 148, 242/151, 152, 36, 37 R, 150 R, 150 M, 147 M

[56] References Cited

U.S. PATENT DOCUMENTS

| | | | |
|---|---|---|---|
| 3,676,769 | 7/1972 | Loepfe . | |
| 4,123,014 | 10/1978 | McCullough | 242/152.1 |
| 4,516,738 | 5/1985 | Nurk | 242/152.1 |

FOREIGN PATENT DOCUMENTS

| | | | |
|---|---|---|---|
| 0139231 | 5/1985 | European Pat. Off. . | |
| 1018644 | 10/1957 | Fed. Rep. of Germany . | |
| 2152907 | 4/1973 | Fed. Rep. of Germany . | |
| 1498049 | 10/1967 | France . | |
| 546840 | 3/1974 | Switzerland . | |
| 401623 | 10/1973 | U.S.S.R. | 242/148 |
| 2059594 | 4/1981 | United Kingdom . | |

*Primary Examiner*—Stanley N. Gilreath

*Attorney, Agent, or Firm*—Flynn, Thiel, Boutell & Tanis

[57] ABSTRACT

An apparatus for detecting a yarn movement comprises a yarn guide unit for the sliding guidance of a moving yarn, and a converter cooperating with the yarn guide unit for generating an electric signal. With the aim of improving the signal-noise ratio of an apparatus of this type, there is provided a member mounted for movement relative to the yarn guide unit and disposed such that the yarn is guided between the member and the yarn guide unit in simultaneous contact with the member and the yarn guide unit, the member being subjected to a biasing action relative to the yarn guide unit.

11 Claims, 1 Drawing Sheet

APPARATUS FOR DETECTING A YARN MOVEMENT

The invention relates to an apparatus for detecting yarn movement.

DESCRIPTION OF THE PRIOR ART

According to the prior art, there is known an apparatus for detecting yarn movement comprising a yarn guide unit through which a yarn can be passed, the yarn guide unit having a support surface adapted to be frictionally engaged by the yarn, a converter element associated with the support surface for generating an electrical output signal indicative of a longitudinal yarn movement and a member for biasing the yarn into engagement with the support surface for mechanically amplifying the signal, the member being movably mounted relative to the support surface in the yarn guide unit.

In an apparatus of the type defined as known from Swiss Patent 546,840, a member acting on the yarn is a contact member maintained in point contact with the yarn for biasing it into engagement with a support surface of a friction body by acting directly on the yarn at its contact point with the support surface to thereby amplify the useful signals by increasing the contact pressure of the yarn by mechanical means. The contact member is spring-loaded.

In a yarn monitoring apparatus known from FR-A-1,498,049, the presence and/or movement of the unbroken yarn is detected by guiding it under tension over a support surface belonging to a cantilevered resilient tongue member the other end of which transmits any vibrations directly to the converter element. A large proportion of the energy transmitted by the yarn to the support surface is dissipated by the deformation of the tongue member and its movement about its mounting location. As a result, the useful signal is only of a limited strength.

In an apparatus known from Swiss Patent 479 478 (corresponding to U.S. Pat. No. 3,676,769), a member is a pressure-exerting member biasing the yarn into engagement with a support surface with a sufficient contact pressure. The pressure-exerting member serves the purpose of creating an additional electrostatic charge by frictional engagement with the yarn, resulting in strong potential variations which are readily detectable for thus detecting the movement of the yarn.

In an apparatus known from EP-A 0,139,231 (corresponding to U.S. Pat. No. 4,605,875), the yarn is deflected through a guide ring connected to a foot portion. Provided on the foot portion is a piezo-electric converter element for converting vibrations of the guide ring into electric signals. The longitudinal movement of the yarn results in such vibrations of the guide ring due to its frictional contact therewith. As long as the yarn is not moved, however, this arrangement results in a relatively strong noise signal, so that the output signal of the converter element is difficult to detect or even unfit for use due to the unfavourable signal-to-noise ratio. A movement of a smooth yarn at a slow rate of advance is scarcely detectable.

An apparatus known from DE-B-1,018,644 serves for detecting a yarn or web breakage. In this apparatus, a ball member biased towards a switch contact is prevented from making contact by the yarn or web as long as it is not broken. A movement of the yarn or web is not indicated.

Known from GB-A-2,059,594 is an apparatus for indicating the presence and movement of a yarn by the employ of a piezo-electric converter element directly engaged by the yarn. The converter element is shaped as a cantilevered rod fixedly mounted at one end and contacted by the yarn at its opposite free end. A pre-biased resilient stop member acts on the converter element at a location between its fixed and free ends in a direction substantially parallel to the direction of movement of the yarn. The converter element monitors the yarn directly.

It is an object of the present invention to improve an apparatus of the type described above so as to result in an improved signal-to-noise ratio of the output signal while being of simple construction.

SUMMARY OF THE INVENTION

This object is attained, according to the invention, providing an apparatus for detecting yarn movement comprising a yarn guide unit for slidably guiding a moving yarn, and a converter cooperating with the yarn guide unit for generating an electric signal. With the aim of improving the signal-noise ratio of an apparatus of this type, there is provided a member mounted for movement relative to the yarn guide unit and disposed such that the yarn is guided between the member and the yarn guide unit in simultaneous contact with the member and the yarn guide unit, the member being subjected to a biasing action relative to the yarn guide unit. The converter cooperates with the member for generating the output signal in response to movements of the member and the support surface relative to one another and for monitoring the movements of the member and/or its impacts on said support surface.

In this embodiment, it is not the yarn itself which is primarily used for generating the useful signal, but rather the member moved by the yarn during its longitudinal movement, the movements of this member being readily detectable. Since the detected signal resulting from the movement of the member are substantially stronger than the noise signal in the stationary state of the yarn and the member, the signal-to-noise ratio of the output signal is considerably improved. Especially in the case of slow movements of a smooth yarn, the moving member will generate a strong output signal via the converter element. Any movement of the yarn results in a movement of the support surface and the movably supported member relative to one another, resulting in a relatively great amplitude of the converter element output signal even at low yarn speeds. Even in the case of aggravating exterior influences a reliable differentiation between the stationary state and movement of the yarn is possible, and that is substantially independent of the quality and speed of the yarn. It is not the relatively high contact pressure exerted by the yarn on the support surface which is the decisive criterion, but rather the movement of the member relative to the support surface caused by the movement of the yarn and used for generating the output signal.

When the member is subjected to a biasing force acting thereon, preferably in a resilient manner, in the direction towards the support surface, it will always tend to rapidly return to the support surface after having been moved away therefrom, resulting in conspicuous movements of the member relative to, or even impacts thereof on, the support surface, to thereby unequivocally inform the converter element of the fact that the yarn is moving. However, as long as the yarn is not moving, the biasing force acts to keep the member very still, resulting in a distinctive difference detectable by the converter element.

When the member cooperates with the support surface to simultaneously act as a yarn brake for the yarn the longitudinal movement of which is to be monitored, the usefulness of the apparatus is considerably broadened. Although in this case the apparatus occupies only a very small space, it is capable of performing a dual function, which is highly advantageous in view of the frequently very restricted accommodation space. A yarn brake is required in many cases. When the apparatus itself is capable of performing the yarn brake function, it is possible to do without an additional yarn brake.

When the support surface is provided on a yarn guide ring of the yarn guide unit, and the member is a ball engaging the yarn guide ring at its downstream side and having a diameter which is greater than the interior diameter of the yarn guide ring, the construction of the apparatus for detecting a longitudinal yarn movement is considerably simplified, while the apparatus is readily capable of performing the additional function of a yarn brake. When thus employing a ball as the movable member, a constant and uniform signal generating function is ensured irrespective of the location of the yarn in the yarn guide ring.

A structurally advantageous embodiment of the apparatus makes use of a metal ball biased into preferably axial engagement with the yarn guide ring by a magnetic field. The magnetic field offers the advantage that the metal ball member is always attracted toward the yarn guide ring as by an invisible spring, and that the yarn may pass through the yarn guide ring at any circumferential location without contacting any part of the apparatus other than the yarn guide ring and the metal ball member. The metal ball member is nevertheless prevented from dropping out, because the magnetic force acts uniformly in all directions and always tends to attract the metal ball member towards the yarn guide ring in the axial direction.

Under these aspects it is advantageous to arrange a plurality of magnets about the yarn guide ring so as to be radially adjustable. Since the magnets are disposed at the upstream side of the yarn guide ring, they generate a biasing force acting on the metal ball member in the axial direction towards the yarn guide ring, resulting in the advantage that the return movement of the metal ball member after its displacement by the yarn is very distinctive, or even that the metal ball member impacts on the support surface of the yarn guide ring. This permits readily detectable signals to be generated. The radial adjustability of the magnets permits the biasing force of the member to be accurately selected.

In a preferred embodiment the yarn guide ring consists of a ceramic material, the yarn guide unit comprises resilient suspension means for the yarn guide ring, and the converter element is a piezo-electric sensor connected to the yarn guide ring and embedded in the resilient suspension means. The contact pressure of the member displaced by the yarn or the impacts of the member are transmitted to the converter element without any delay and without losses, resulting in the immediate generation of a strong output signal.

It is also advantageous that the engagement force of the member is adjustable so as to permit the amplification of the output signal and/or the yarn braking action to be varied. In this manner it is possible to readily adapt the apparatus to given yarn qualities and yarn speeds. It is also possible to selectively adjust the response threshold of the apparatus.

An alternative embodiment is characterized in that the movable member consists of a metal or contains a metal insert, and that the converter element is a stationarily mounted proximity sensor directed onto the movable member. In this embodiment it is not absolutely necessary that the movable member impacts on the support surface in the course of its movements caused by the yarn. It is rather sufficient for the movable member to be displaced relative to the proximity sensor to thereby cause the latter to generate an output signal which is substantially stronger than the noise signal generated when the yarn is not moving.

BRIEF DESCRIPTION OF THE DRAWINGS

Embodiments of the subject matter of the invention shall now be described by way of example with reference to the drawings, wherein.

DESCRIPTION OF PREFERRED EMBODIMENTS

Figure 1:
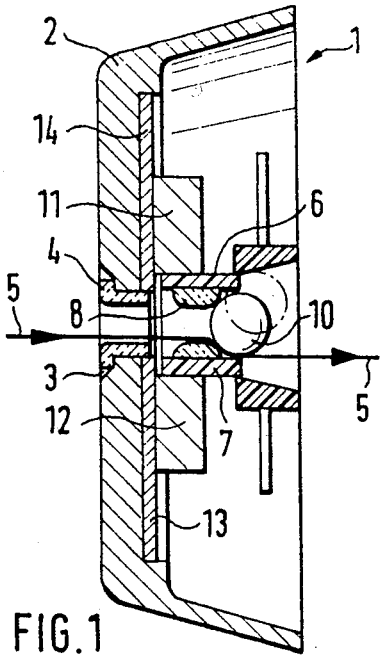
FIG. 1 is a cross-sectional, view taken along the line I—I in FIG. 2 detecting a yarn movement, which is at the same time useful as a yarn brake.
Figure 2:
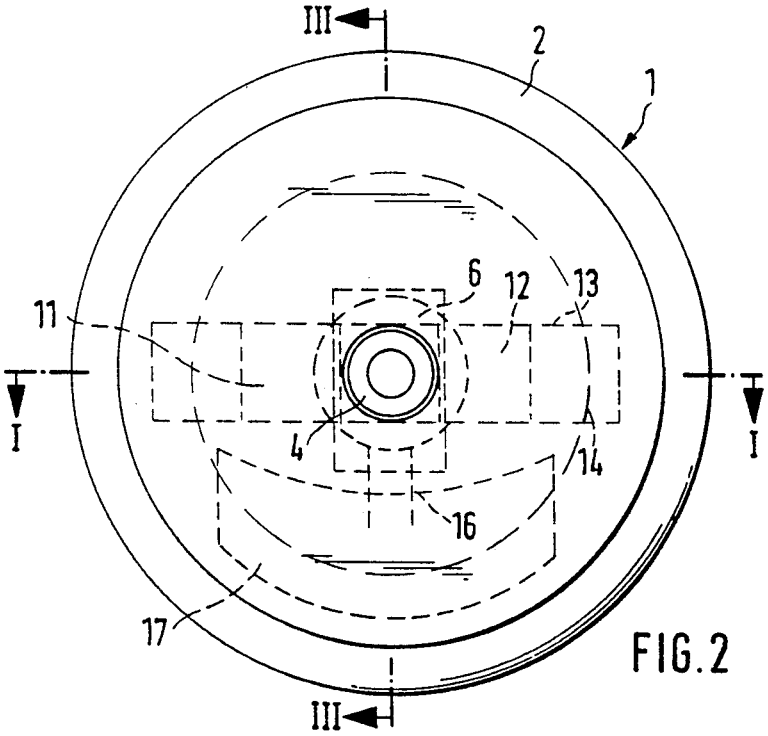
FIG. 2 is an end view of the apparatus of FIG. 1 in the direction of a yarn passing therethrough.

According to FIG. 1, an apparatus 1 devised both for detecting a yarn movement and for braking the yarn comprises a cup-shaped aluminum or plastic housing 2 having a central axial bore 3. Fixedly secured in bore 3 is a ceramic inlet guide bushing 4. Disposed downstream of inlet guide bushing 4 in the running direction of a yarn 5 is a yarn guide unit 6 provided with a suspension ring 7 made of an elastic material and connected to housing 2. Mounted in suspension ring 7 is a ceramic guide ring 8. Provided downstream of yarn guide unit 6 in the yarn running direction is a radially symmetric seat 9 having a conical inner bore coaxially aligned with bore 3 and serving for threading the yarn 5 therethrough. Guide ring 8 is formed with a rounded transition between its cylindrical inner surface and its end faces so as to ensure the smooth passage therethrough of yarn 5 and to provide a rounded support surface for the yarn and a member 10 disposed at the yarn exit side of the guide ring. Member 10 is for instance a metal ball the diameter of which is greater than the interior diameter of the guide ring. Member 10 is subjected to the action of a magnetic field biasing it in the axial direction opposite the yarn running direction towards the support surface of guide ring 8. The magnetic field is generated by for instance two bar magnets 11, 12 disposed at the yarn entry side of guide ring 8 at radially aligned positions with respect to the axis of bore 3. As shown in FIGS. 1 and 2, bar magnets 11, 12 are retained in groove-shaped recesses 13 of housing 2 so as to be radially adjustable relative to the axis of bore 3 to thereby permit the strength of the magnetic field acting on member 10 to be selectively varied. The strength of the magnetic field determines the contact pressure between member 10 and the support surface of yarn guide ring 8, and thus likewise the braking action exerted by member 10 on yarn 5. Referring to FIG. 1, the downstream end of the guide ring 8 provides a seat onto which the member 10 is urged by the magnetic field.

Additionally mounted in housing 2 is a soft-magnetic annular disc 14 for focussing the magnetic field.

As shown by dash-dotted lines in FIG. 1, member 10 may be displaced to a radially off-center position in the internal bore of seat 9 to thereby facilitate the threading of yarn 5.

Figure 3:
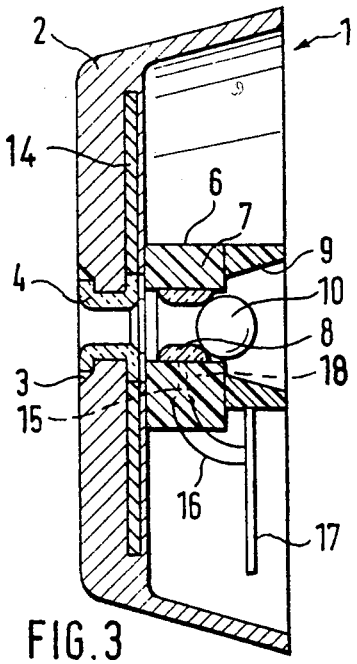
FIG. 3 is sectional view of the apparatus of FIG. 2, taken along the line III—III.

According to FIG. 3, ceramic guide ring 8 has an extension 18 to which a piezo-electric converter element or transducer 15 is adhesively secured. Element 15 has terminals 16 for connection to a circuit board 17 for the pre-amplification of the output signal which in its amplified state is applied to a not shown evaluator circuit.

The biasing force acting on member 10 may also be supplied by a spring element or the action of gravity.

In the described embodiment the yarn guide unit 6 is provided with a stationary guide ring 8. In a modification it is also possible to employ a centrally mounted stationary member with the yarn guide unit movably mounted relative thereto. This arrangement will also result in the effect that the movement of the yarn guide unit relative to the stationary member produces a mechanical amplification of the converter signal. The only thing that matters is that the longitudinal movement of the yarn results in a movement of the member and the support surface relative to one another, the output signal resulting from this movement being more distinctive than the signal resulting from the movement of the yarn relative to the support surface.

It is also conceivable to employ other converter elements, for instance capacitive proximity sensors, inductive elements for detecting relative movements or any other elements known in the art for generating a signal indicative of the movement of two bodies relative to one another.

The member 10 may also assume the form of a cone or a wedge rather than a spherical shape. It is not either absolutely necessary that the member 10 and/or the yarn guide unit 6 be of rotation-symmetrical configuration, it being also possible to employ a mirror-symmetrical configuration relative to a symmetry plane. It is solely of decisive importance that the member which is movable relative to the support surface of the yarn guide unit contacts the yarn simultaneously with the yarn guide unit itself, so that the longitudinal movement of the yarn necessarily results in a movement of the member and the yarn guide unit, or its support surface, respectively, relative to one another. Possible embodiments of the member and the yarn guide unit include for instance curved slide surfaces engaging the yarn at opposite sides, or cylindrical elements likewise engaging opposite sides of the yarn. Also conceivable are non-symmetrical configurations of the movable member and the yarn guide unit.

In addition to its function of detecting the longitudinal yarn movement, the apparatus 1 is also capable of acting as a yarn brake, because yarn 5 has always to be pulled through the gap between the member 18 and the support surface defined by guide ring 8, the biasing force acting on member 10 resulting in a yarn braking action. On the one hand, the biasing force, the magnitude of which is adjustable as explained above, determines the strength of the output signal in cooperation with the mass of the member. On the other hand, the biasing force also determines the braking action capable of being generated by the action of apparatus 1 as a yarn brake. The adjustment of the biasing force thus permits both the output signal amplification and the yarn braking action to be varied, the above mentioned modifications of constructions and shapes of the cooperating components making it possible to determine beforehand the relative magnitudes of the output signal amplification effect and/or the yarn braking effect.

In the embodiment shown, member 10 is in contact with the support surface of yarn guide ring 8 as long as yarn 5 is not moved. This mutual engagement may be in the form of a point contact. Member 10 acts to hold yarn 5 in contact with the support surface. Converter element 15 generates a noise signal, which is relatively weak, however. As soon as yarn 5 is imparted a longitudinal movement through bore 3, member 10 is displaced relative to the support surface, the biasing force constantly acting thereon during its movements causing it to repeatedly impact on the support surface. Converter element 15 responds to these alternating movements and impacts of member 10 and generates an output signal clearly distinctive from the noise signal. When a proximity sensor is employed, it is not necessary for the member to constantly or repeatedly contact the support surface, inasmuch as the proximity sensor is capable of generating a distinctive output signal in response to the relative movements of the member.

Figure 4:
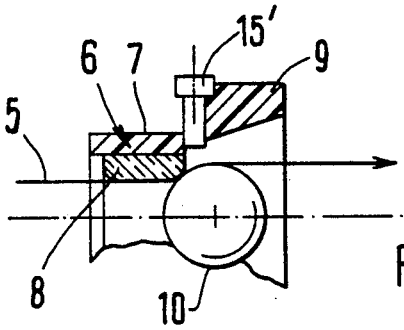
FIG. 4 is a view corresponding to a fragment of FIG. 1, and illustrating a modification in which a proximity sensor is used.

Referring to FIG. 4, the proximity sensor 15' detects whether the member 10 moves toward or away from the sensor 15' and thus generates a signal which represents the movement of member 10 under the influence of yarn 5 and consequently the movement of the yarn.

I claim:

1. Apparatus for detecting a yarn movement, comprising a yarn guide unit having a yarn passing therethrough and provided with a support surface adapted to be frictionally engaged by said yarn, a converter element associated with said support surface for generating an electric output signal indicative of a longitudinal yarn movement, and a member for biasing said yarn into engagement with said support surface for mechanically amplifying said signal, means for supporting said member for movement relative to said support surface in response to said longitudinal yarn movement, said converter element including means responsive to movement of said member relative to said support surface for generating said output signal and for monitoring the movements of said member and/or its impacts on said support surface.

2. Apparatus according to claim 1, including means biasing said member into contact with said support surface.

3. Apparatus according to claim 2, in which said member is engagable with said support surface to form a yarn brake for said yarn passing between said member and said support surface.

4. Apparatus according to claim 1, in which said support surface is provided on a yarn guide ring of said yarn guide unit, and said member is a ball the diameter of which is greater than the interior diameter of said yarn guide ring, said ball engaging said yarn guide ring at the downstream side thereof.

5. Apparatus according to claim 4, in which said ball is a metal ball biased into axial engagement with said yarn guide ring by a magnetic field, and said yarn guide ring is mounted in a stationary position.

6. Apparatus according to claim 5, in which a plurality of magnets is distributed about said yarn guide ring at the upstream side thereof, at adjustable positions relative to the support surface of said yarn guide ring.

7. Apparatus according to claim 4, in which said yarn guide ring consists of a ceramic material, said yarn guide unit comprises resilient suspension means for supporting said yarn guide ring, and said converter element is a piezo-electric sensor connected to said yarn guide ring and embedded in said resilient suspension means.

8. Apparatus according to claim 2, including means for varying the contact pressure of said member against said support surface for varying the amplification of said output signal and/or the yarn braking action.

9. Apparatus according to claim 1, in which said member includes a metal portion and said converter element is a stationarily mounted proximity sensor.

10. Apparatus for detecting yarn movement, comprising: a housing made of non-magnetic material, said housing having a central axial bore; a ceramic inlet guide bushing mounted in said bore, said bushing providing an inlet for yarn; a tubular yarn guide unit mounted on said housing, said yarn guide unit being axially aligned with and being disposed downstream of said bushing in the direction of yarn travel, said yarn guide unit comprising an elastic suspension ring attached to said housing and a ceramic guide ring mounted in said suspension ring in axial alignment with said bushing so that the yarn will travel through said guide ring, said ceramic guide ring having a ball seat formed on the downstream end thereof in the direction of yarn travel; a magnetically attractable, freely movable ball disposed in said housing for contacting said ball seat and for engaging the yarn; magnet means mounted in said housing for generating a magnetic field effective to continuously attract said ball toward said ball seat; a piezo-electric transducer mounted on said guide ring and responsive to movement of said ball caused by longitudinal yarn movement to generate an output signal indicative of yarn movement.

11. A yarn brake comprising a yarn guide unit having a support surface along which the yarn can travel and having a yarn brake seat; a movable yarn brake member yieldably biased into seating engagement with said yarn brake seat, said brake member being displaceable away from said yarn brake seat in response to longitudinal yarn movement; and a transducer effective to generate an electrical output signal indicative of longitudinal yarn movement in response to movement of said yarn brake member relative to said support surface.

* * * * *